US007288884B2

(12) United States Patent
Kang et al.

(10) Patent No.: US 7,288,884 B2
(45) Date of Patent: Oct. 30, 2007

(54) FIELD EMISSION BACKLIGHT UNIT HAVING EMITTERS DISPOSED ON EDGES OF ELECTRODES

(75) Inventors: Ho-Suk Kang, Seoul (KR); In-Taek Han, Seoul (KR); Yong-Wan Jin, Seoul (KR); Min-Jong Bae, Anyang-si (KR); Young-Jun Park, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 44 days.

(21) Appl. No.: 10/980,793

(22) Filed: Nov. 4, 2004

(65) Prior Publication Data

US 2005/0152155 A1 Jul. 14, 2005

(30) Foreign Application Priority Data

Jan. 8, 2004 (KR) ..... 10-2004-0001102

(51) Int. Cl.
*H01J 1/62* (2006.01)

(52) U.S. Cl. ..... 313/497; 313/495; 313/496

(58) Field of Classification Search ..... 313/495–497, 313/306–308

See application file for complete search history.

(56) References Cited

U.S. PATENT DOCUMENTS

2002/0060514 A1* 5/2002 Nakamoto ..... 313/311
2003/0082983 A1* 5/2003 Hwang et al. ..... 445/24
2003/0090190 A1* 5/2003 Takai et al. ..... 313/311
2005/0116612 A1* 6/2005 Oh ..... 313/497

FOREIGN PATENT DOCUMENTS

KR 1020020033948 A 8/2002

* cited by examiner

*Primary Examiner*—Joseph Williams
*Assistant Examiner*—Bumsuk Won
(74) *Attorney, Agent, or Firm*—Robert E. Bushnell, Esq.

(57) ABSTRACT

A field emission backlight unit for a liquid crystal display (LCD) includes: a lower substrate; first electrodes and second electrodes alternately formed in parallel lines on the lower substrate; emitters disposed on at least the first electrodes; an upper substrate spaced apart from the lower substrate by a predetermined distance such that the upper and lower substrates face each other; a third electrode formed on a bottom surface of the upper substrate; and a fluorescent layer formed on the third electrode. Since the backlight unit has a triode-type field emission structure, field emission is very stable. Since the first electrodes and the second electrodes are formed in the same plane, brightness uniformity is improved and manufacturing processes are simplified. If the emitters are disposed on both the first electrodes and the second electrodes, and a cathode voltage and a gate voltage are alternately applied to the first electrodes and second electrodes, the lifespan and brightness of the emitters can be improved. The above advantages are also achieved as a result of the method of driving the backlight unit and the method of manufacturing the lower panel thereof.

12 Claims, 9 Drawing Sheets

FIELD EMISSION BACKLIGHT UNIT HAVING EMITTERS DISPOSED ON EDGES OF ELECTRODES

CLAIM OF PRIORITY

This application makes reference to, incorporates the same herein, and claims all benefits accruing under 35 U.S.C. §119 from an application for FIELD EMISSION BACKLIGHT UNIT, METHOD OF DRIVING THE BACKLIGHT UNIT, AND METHOD OF MANUFACTURING LOWER PANEL earlier filed in the Korean Intellectual Property Office on Jan. 8, 2004 and there duly assigned Ser. No. 2004-1102.

BACKGROUND OF THE INVENTION

1. Technical Field

The present invention relates to a backlight unit for a liquid crystal display and, more particularly, to a field emission backlight unit.

2. Related Art

In general, flat panel displays are largely classified into light emitting displays and light receiving displays. Light emitting flat panel displays include cathode ray tubes (CRTs), plasma display panels (PDPs), and field emission displays (FEDs), and light receiving flat panel displays include liquid crystal displays (LCDs). Among these flat panel displays, LCDs have the advantages of light weight and low power consumption, but have a disadvantage in that, since they form an image not by emitting light by itself but by receiving light from an outside source, the image cannot be viewed in a dark place. To solve this problem, a backlight unit for emitting light is installed at a rear surface of the LCD so that the LCD can form an image in a dark place.

A conventional backlight unit uses a linear or a point light source. Typically, a cold cathode fluorescent lamp (CCFL) is used as the linear light source, and a light emitting diode (LED) is used as the point light source. However, the conventional backlight unit is disadvantageous in that, since its structure is complex, manufacturing costs are high, and since the light source is disposed at the side of the backlight unit, power consumption is high when light is reflected and transmitted. In particular, as the LCD becomes larger, it becomes more difficult to achieve uniform brightness with the conventional backlight unit.

Accordingly, in recent years, a field emission backlight unit having a planar light emitting structure has been suggested. The field emission backlight unit has lower power consumption and more uniform brightness over a larger area than the backlight unit using the typical CCFL.

Korean Patent Publication No. 2002-33948 discloses a conventional field emission backlight unit. An indium tin oxide (ITO) electrode layer and a fluorescent layer are sequentially stacked on a bottom surface of an upper substrate. A thin metal layer and a carbon nanotube layer are sequentially stacked on a lower substrate. The upper substrate and the lower substrate are bonded to each other with a spacer therebetween. A glass tube for vacuum ventilation is installed in the lower substrate.

In the backlight unit constructed as above, if a voltage is applied between the ITO electrode layer and the thin metal layer, electrons are emitted from the carbon nanotube layer and collide against the fluorescent layer. As a result, fluorescent materials in the fluorescent layer become excited and emit visible light.

However, the conventional field emission backlight unit has a diode-type field emission structure in which the ITO electrode layer disposed on the upper substrate is used as an anode and the thin metal layer disposed on the lower substrate is used as a cathode. Since a high voltage used for emitting electrons is directly applied between the anode and the cathode, this diode-type structure is vulnerable to local arcing. If such local arcing occurs, brightness cannot be kept uniform over the entire surface of the backlight unit, and the ITO electrode layer, the fluorescent layer, and the carbon nanotube layer gradually become damaged, thereby reducing the lifespan of the backlight unit.

SUMMARY OF THE INVENTION

The present invention provides a field emission backlight unit having a triode-type field emission structure, which can ensure uniform brightness and prolong lifespan.

The present invention further provides a method of driving a field emission backlight unit so as to ensure uniform brightness and prolonging lifespan.

The present invention further provides a method of manufacturing a lower panel of the field emission backlight unit.

According to an aspect of the present invention, there is provided a field emission backlight unit comprising: a lower substrate; first electrodes and second electrodes alternately formed in parallel lines on the lower substrate; emitters disposed on at least the first electrodes of the first and second electrodes; an upper substrate spaced apart from the lower substrate by a predetermined distance such that the upper and lower substrates face each other; a third electrode formed on a bottom surface of the upper substrate; and a fluorescent layer formed on the third electrode.

The emitters may be made of carbon nanotubes. The first electrodes and second electrodes may include indium tin oxide electrode layers formed on the lower electrode and thin metal layers formed on the indium tin oxide electrode layers.

The emitters may be disposed on only the first electrodes such that the first electrodes serve as cathodes, the second electrodes serve as gate electrodes, and the third electrode serves as an anode.

In this case, the plurality of emitters may be disposed along both edges of the first electrodes at predetermined intervals. A plurality of emitter grooves may be formed along both edges of the first electrodes, and the emitters may be formed in the plurality of emitter grooves.

Also, the emitters may be disposed on both the first electrodes and the second electrodes such that the first electrodes and the second electrodes serve as cathodes and gate electrodes alternately, and the third electrode serves as an anode.

In this case, the plurality of emitters may be disposed along both edges of both the first electrodes and the second electrodes at predetermined intervals. The emitters disposed on the first electrodes and the emitters disposed on the second electrodes may be arranged by turns. A plurality of emitter grooves may be formed along both edges of both the first electrodes and the second electrodes, and the emitters may be formed in the plurality of emitter grooves.

According to another aspect of the present invention, there is provided a method of driving a triode-type field emission backlight unit including a lower panel on which first electrodes, second electrodes, and emitters disposed on both the first electrodes and the second electrodes are formed, and an upper panel on which a third electrode is formed, the method comprising the steps of: applying a cathode voltage to the first electrodes, a gate voltage to the second electrodes, and an anode voltage to the third electrode so as to emit electrons from the emitters disposed on the first electrodes; applying a gate voltage to the first electrodes, a cathode voltage to the second electrodes, and an anode voltage to the third electrode so as to emit electrons from the emitters disposed on the second electrodes; and repeating the above steps.

According to still another aspect of the present invention, there is provided a method of manufacturing a lower panel of a field emission backlight unit, the method comprising the steps of: forming a conductive material layer on a transparent substrate; patterning the conductive material layer in parallel lines to form alternating first electrodes and second electrodes, and forming a plurality of emitter grooves at predetermined intervals along both edges of at least the first electrodes; coating a photoresist material layer on the substrate on which the first electrodes and the second electrodes are formed; patterning the photoresist material layer to expose the emitter grooves; coating a carbon nanotube paste on the photoresist material layer and in the emitter grooves; selectively exposing the carbon nanotube paste to form carbon nanotube emitters in the emitter grooves; and stripping the photoresist material layer and removing unexposed portions of the carbon nanotube paste.

The conductive layer forming step may comprise: forming an indium tin oxide electrode layer on the substrate; and forming a thin metal layer on the indium tin oxide electrode layer.

The emitter groove forming step may comprise forming the emitter grooves along both edges of both the first electrodes and the second electrodes.

The first and second electrode forming step may comprise: coating a photoresist material layer on the conductive material layer; patterning the photoresist material layer using photolithography process; etching the conductive material layer using the patterned photoresist material layer as an etching mask; and stripping the photoresist material layer.

The carbon nanotube paste coating step may comprise coating the carbon nanotube paste using a screen printing method.

The carbon nanotube emitter forming step may comprise exposing the carbon nanotube paste from a rear surface of the substrate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
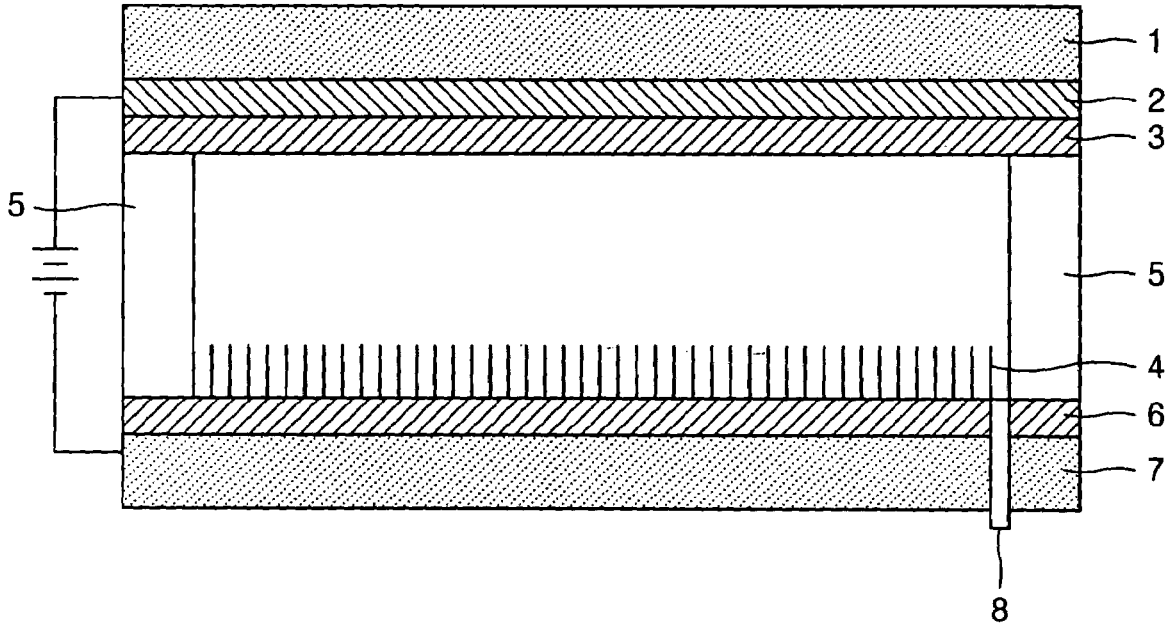
FIG. 1 is a cross-sectional view of a field emission backlight unit.

The present invention will now be described more fully with reference to the accompanying drawings, in which preferred embodiments of the invention are shown. In the drawings, whenever the same element reappears in a subsequent drawing, it is denoted by the same reference numeral.

FIG. 1 is a cross-sectional view of a field emission backlight unit. Referring to FIG. 1, an indium tin oxide (ITO) electrode layer 2 and a fluorescent layer 3 are sequentially stacked on a bottom surface of an upper substrate 1. A thin metal layer 6 and a carbon nanotube layer 4 are sequentially stacked on a lower substrate 7. The upper substrate 1 and the lower substrate 7 are bonded to each other with a spacer 5 therebetween. A glass tube 8 for vacuum ventilation is installed in the lower substrate 7.

In the backlight unit constructed as above, if a voltage is applied between the ITO electrode layer 2 and the thin metal layer 6, electrons are emitted from the carbon nanotube layer 4 and collide against the fluorescent layer 3. As a result, fluorescent materials in the fluorescent layer 3 become excited and emit visible light.

The field emission backlight unit has a diode-type field emission structure in which the ITO electrode layer 2 disposed on the upper substrate 1 is used as an anode and the thin metal layer 6 disposed on the lower substrate 7 is used as a cathode. Since a high voltage used for emitting electrons is directly applied between the anode and the cathode, this diode-type structure is vulnerable to local arcing. If such local arcing occurs, brightness cannot be kept uniform over the entire surface of the backlight unit, and the ITO electrode layer 2, the fluorescent layer 3, and the carbon nanotube layer 4 gradually become damaged, thereby reducing the lifespan of the backlight unit.

Figure 2:
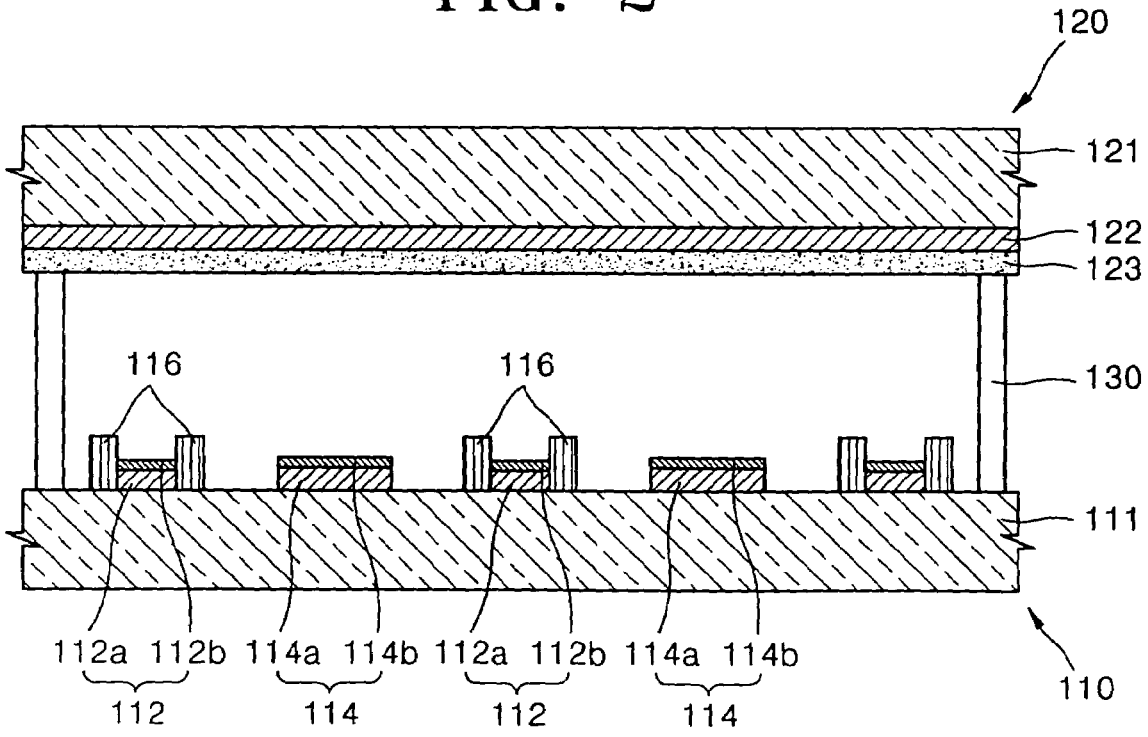
FIG. 2 is a partial sectional view of a field emission backlight unit according to a first preferred embodiment of the present invention.
Figure 3:
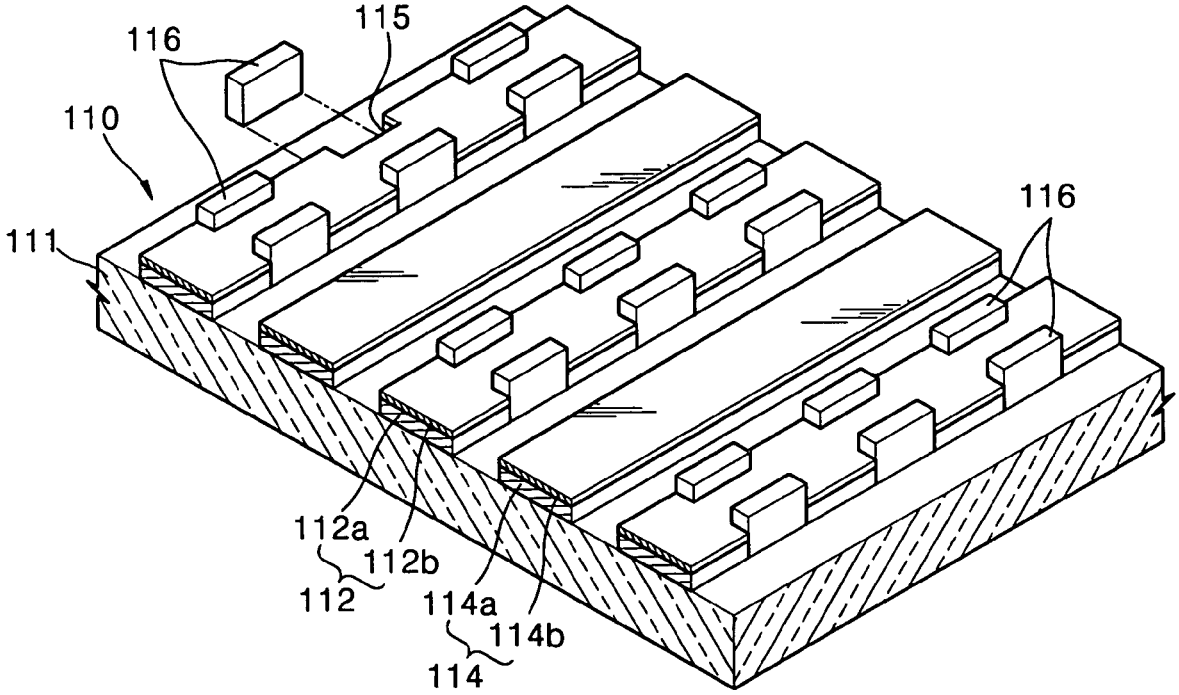
FIG. 3 is a partial perspective view of a lower panel of the backlight unit of FIG. 2.

FIG. 2 is a partial sectional view of a field emission backlight unit according to a first preferred embodiment of the present invention, and FIG. 3 is a partial perspective view of a lower panel of the backlight unit of FIG. 2.

Referring to FIGS. 2 and 3, the field emission backlight unit includes a lower panel 110 and an upper panel 120, which are spaced apart by a predetermined distance and face each other. The lower panel 110 and the upper panel 120 are constructed so as to be suitable for triode-type field emission.

Specifically, the lower panel 110 includes a transparent lower substrate 111 which may be made of glass, first electrodes 112 and second electrodes 114 which are formed on the lower substrate 111 and which act as cathodes and gate electrodes, respectively, and carbon nanotube emitters 116 which are disposed on the first electrodes 112.

The upper panel 120 includes a transparent upper substrate 121 which may be made of glass, a third electrode 122 which is formed on a bottom surface of the upper substrate 121 and which acts as an anode, and a fluorescent layer 123 which is formed on the third electrode 122.

The lower panel 110 and the upper panel 120 are spaced apart and face each other, and are bonded to each other with a sealing material (not shown) coated on perimeters thereof. As seen in FIG. 2, a spacer 130 is installed between the lower panel 110 and the upper panel 120 to maintain the predetermined distance between the lower panel 110 and upper panel 120.

To be more specific, the first electrodes 112 are arranged in parallel lines on the lower substrate 111 of the lower panel 110 to serve as cathodes, and the second electrodes 114 are arranged in parallel lines on the lower substrate 111 of the lower panel 110 to serve as gate electrodes. The plurality of first electrodes 112 and the plurality of second electrodes 114 are alternately arranged in the same plane. The first electrodes 112 and the second electrodes 114 may include transparent conductive indium tin oxide (ITO) electrode layers 112*a* and 114*a*, respectively, formed on the lower substrate 111, and conductive thin metal layers 112*b* and 114*b*, respectively, formed on the ITO electrode layers 112*a* and 114*a*, respectively, and made of chrome.

However, the first electrodes 112 and the second electrodes 114 may include only the ITO electrode layers 112*a* and 114*a*. The ITO electrode layers 112*a* and 114*a* disadvantageously have a high line resistance. Accordingly, it is preferable in manufacturing a large backlight unit that the thin metal layers 112*b* and 114*b*, acting as bus electrodes for reducing the line resistance of the ITO electrode layers 112*a* and 114*a*, respectively, are formed on the ITO electrode layers 112*a* and 114*a*, respectively.

As previously mentioned, the plurality of first electrodes 112 and the plurality of second electrodes 114 are made of the same materials and are formed in the same plane. Therefore, as will be described when addressing the manufacturing method, the first electrodes 112 and the second electrodes 114 can be simultaneously manufactured, thereby simplifying manufacturing processes and reducing manufacturing costs.

The emitters 116 are formed on the first electrodes 112 that serve as the cathodes. The emitters 116 emit electrons when an electric field is formed by a voltage applied between the first electrodes 112 and the second electrodes 114. The emitters 116 are made of carbon nanotubes (CNTs). The CNTs can smoothly emit electrons at a relatively low driving voltage. Further, as will be described when addressing the manufacturing method, if a CNT paste is used, the CNT emitters 116 can be easily formed on a larger substrate, and accordingly, a larger backlight unit can be manufactured.

According to the first preferred embodiment of the present invention, the plurality of CNT emitters 116 are disposed at predetermined intervals along both longitudinal edges of the first electrodes 112. To be more specific, a plurality of emitter grooves 115 are formed at predetermined intervals along both longitudinal edges of the first electrodes 112, and the CNT emitters 116 are formed in the emitter grooves 115. Since bottom surfaces of the CNT emitters 116 are in contact with a top surface of the transparent lower substrate 111, as will be described when addressing the manufacturing method, the CNT emitters 116 can be formed by exposing the CNT paste from a rear surface of the lower substrate 111.

Figure 4:
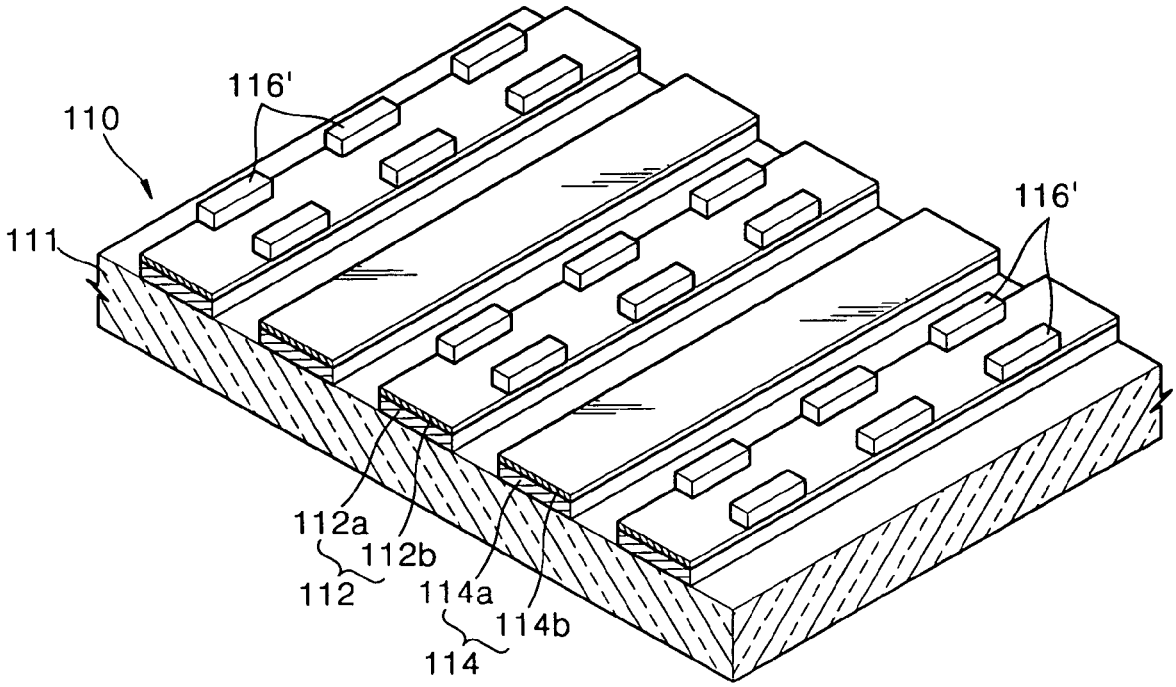
FIG. 4 is a partial perspective view of a modified example of the lower panel of the backlight unit of FIG. 2.

FIG. 4 illustrates a modified example of the lower panel of the backlight unit of FIG. 3. Referring to FIG. 4, CNT emitters 116' are formed on a top surface of the first electrodes 112 along both longitudinal edges of the first electrodes 112. Accordingly, the emitter grooves 115 shown in FIG. 3 are not required, thereby further simplifying the structure of the first electrodes 112. However, it is impossible to form the CNT emitters 116' by the aforesaid backside exposure. Thus, the CNT emitters 116' should be formed by a frontal exposure using an exposure mask.

The CNT emitters 116 and 116' can be formed by various other well-known methods instead of backside and frontal exposure using CNT paste. For example, the CNT emitters 116 and 116' may be formed by chemical vapor deposition. The chemical vapor deposition is performed by forming catalytic metal layers made of nickel or iron on portions on which the emitters are to be formed, and supplying gas containing carbon, such as $CH_4$, $C_2H_2$, or $CO_2$, to vertically grow carbon nanotubes from surfaces of the catalytic metal layers.

Referring to FIGS. 2 and 3 again, the third electrode 122 formed on the bottom surface of the upper substrate 121 serves as an anode, and is made of transparent conductive ITO through which visible light emitted from the fluorescent layer 123 can pass. The third electrode 122 may be formed as a thin film on the entire bottom surface of the upper substrate 121, or may be formed in a predetermined pattern, for example, a stripe pattern, on the bottom surface of the upper substrate 121.

The fluorescent layer 123 is formed on a bottom surface of the third electrode 122, and is made of red (R), green (G), and blue (B) fluorescent materials. The R, G, and B fluorescent materials may be individually coated on the bottom surface of the third electrode 122 in a predetermined pattern, or may be mixed and then coated on the entire bottom surface of the third electrode 122.

A method of driving the field emission backlight unit according to the first preferred embodiment of the present invention will now be explained.

In the field emission backlight unit according to the first preferred embodiment, if predetermined voltages are applied to the first electrodes 112, the second electrodes 114 and the third electrode 122, respectively, an electric field is formed between the electrodes 112, 114 and 122, and electrons are emitted from the CNT emitters 116. A cathode voltage ranging from zero to negative tens of volts is applied to the first electrodes 112, a gate voltage ranging from a few to hundreds of volts is applied to the second electrodes 114, and an anode voltage ranging from hundreds to thousands of volts is applied to the third electrode 122. The electrons emitted from the emitters 116 bombard the fluorescent layer 123. Accordingly, the R, G and B fluorescent materials of the fluorescent layer 123 are excited to emit white visible light.

As described above, since the field emission backlight unit has the triode-type field emission structure, it can perform more stable field emission than a conventional backlight unit having a diode-type field emission structure.

Figure 5:
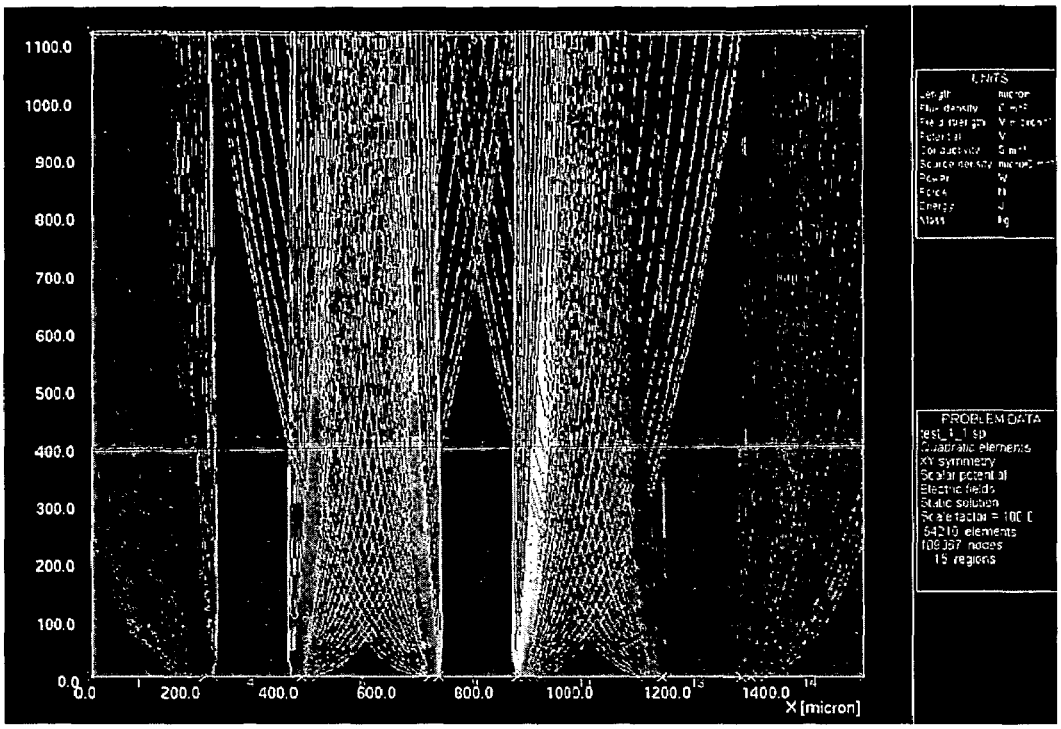
FIG. 5 is a diagram illustrating simulation results of electron beams emitted from the backlight unit of FIG. 2.
Figure 6:
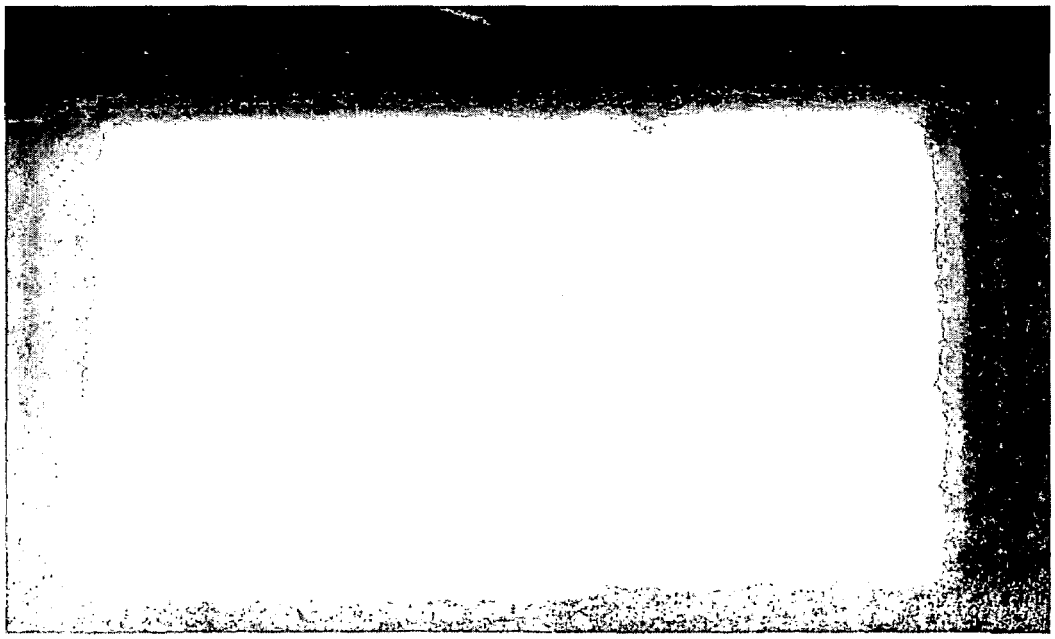
FIG. 6 is a photograph illustrating light-emission test results of the backlight unit of FIG. 2.

FIG. 5 is a diagram illustrating simulation results of electron beams emitted from the backlight unit of FIG. 2, and FIG. 6 is a photograph illustrating light-emission test results of the backlight unit of FIG. 2. In this case, the first electrodes 112 are grounded, a gate voltage of 100 volts is applied to the second electrodes 114, and an anode voltage of 2000 volts is applied to the third electrode 122.

First, referring to FIG. 5, since the first electrodes 112 functioning as the cathodes and the second electrodes 114 functioning as the gate electrodes are formed in the same plane, electrons emitted from the CNT emitters 116 are spread while traveling to the third electrode 122 that functions as the anode. If the electrons are spread in this manner, the entire surface of the fluorescent layer 123 formed on the third electrode 122 can be uniformly excited.

As a result, as shown in FIG. 6, uniform brightness is obtained all over the light emitting surface of the upper panel 120. Here, the brightness is approximately 7000 cd/m$^2$.

Figure 7:
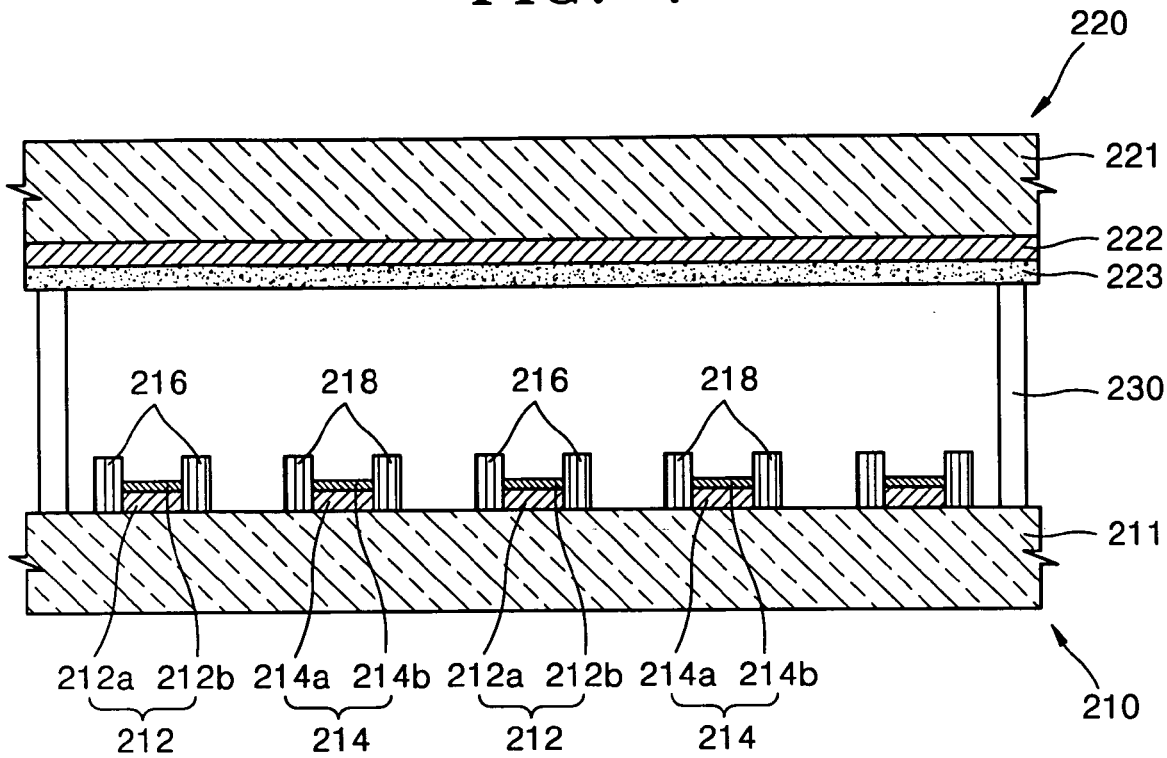
FIG. 7 is a partial sectional view of a field emission backlight unit according to a second preferred embodiment of the present invention.
Figure 8:
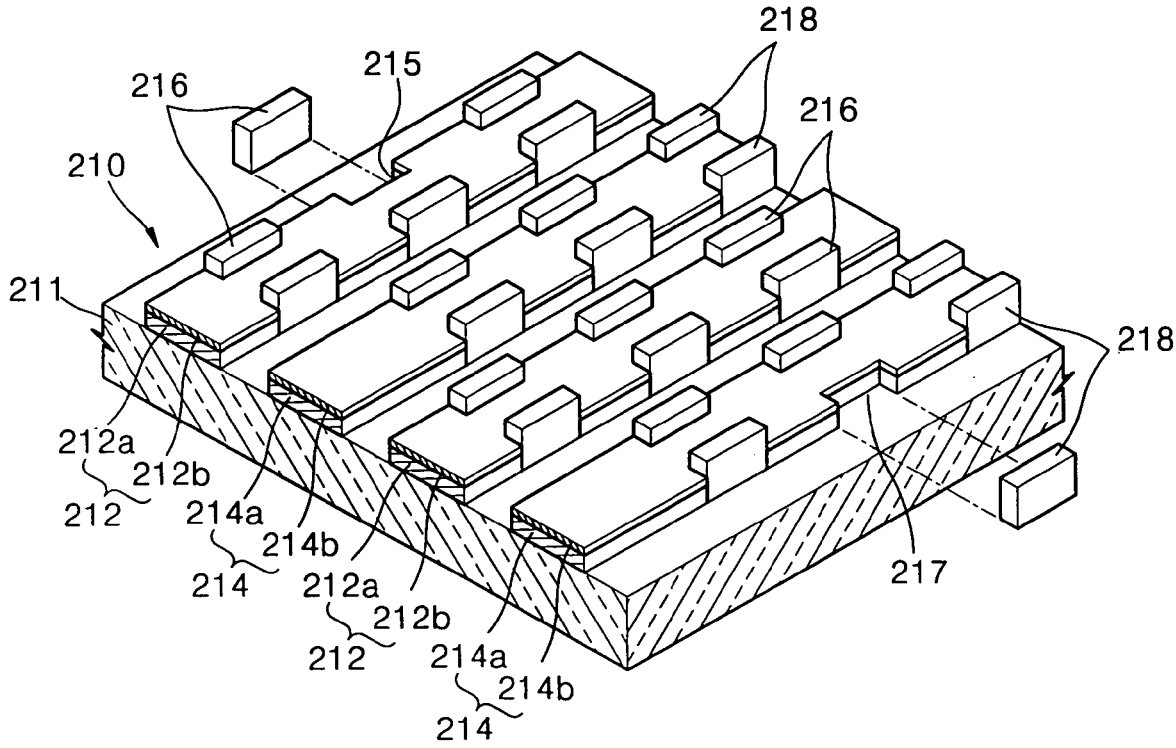
FIG. 8 is a partial perspective view of a lower panel of the backlight unit of FIG. 7.

FIG. 7 is a partial sectional view of a field emission backlight unit according to a second preferred embodiment of the present invention, and FIG. 8 is a partial perspective view of a lower panel of the backlight unit of FIG. 7.

Referring to FIGS. 7 and 8, a backlight unit includes a lower panel 210 and an upper panel 220 which are spaced apart from each other by a spacer 230. The lower panel 210 includes a lower substrate 211, first electrodes 212 and second electrodes 214 formed on the lower substrate 211, and CNT emitters 216 and 218 disposed on the first electrodes 212 and the second electrodes 214, respectively.

The first electrodes 212 and the second electrodes 214 in the second preferred embodiment are arranged in the same form as in the first preferred embodiment, and may include ITO electrode layers 212*a* and 214*a* formed on the lower substrate 211 and thin metal layers 212*b* and 214*b* formed on the ITO electrode layers 212*a* and 214*a* as in the first preferred embodiment.

However, the first electrodes 212 and the second electrodes 214 serve as cathodes and gate electrodes alternately. To this end, the CNT emitters 216 and 218 are formed on the first electrodes 212 and the second electrodes 214, respectively. That is, the plurality of CNT emitters 216 are disposed at predetermined intervals along both longitudinal edges of the first electrodes 212, and the plurality of CNT emitters 218 are disposed at predetermined intervals along both longitudinal edges of the second electrodes 214. To easily form the CNT emitters 216 and 218 using a backside exposure method, a plurality of emitter grooves 215 and 217 are formed along both edges of the first electrodes 212 and the second electrodes 214, respectively. In particular, it is preferable that the CNT emitters 216 and 218 are arranged by turns, such that the CNT emitters 216 formed on the first electrodes 212 face the second electrodes 214, and the CNT emitters 218 formed on the second electrodes 214 face the first electrodes 212. Consequently, electrons can be more smoothly emitted from the CNT emitters 216 and 218.

On the other side, the modified example of the lower panel of the backlight unit of FIG. 4 can be applied to the second preferred embodiment of the present invention.

The upper panel 220 includes an upper substrate 221, a third electrode 222 formed on a bottom surface of the upper substrate 221 and serving as an anode, and a fluorescent layer 223 formed on the third electrode 222. The detailed construction of the upper panel 220 is the same as that of the upper panel 120 in the first preferred embodiment.

A method of driving the backlight unit according to the second preferred embodiment of the present invention will now be explained with reference to FIG. 9.

Figure 9:
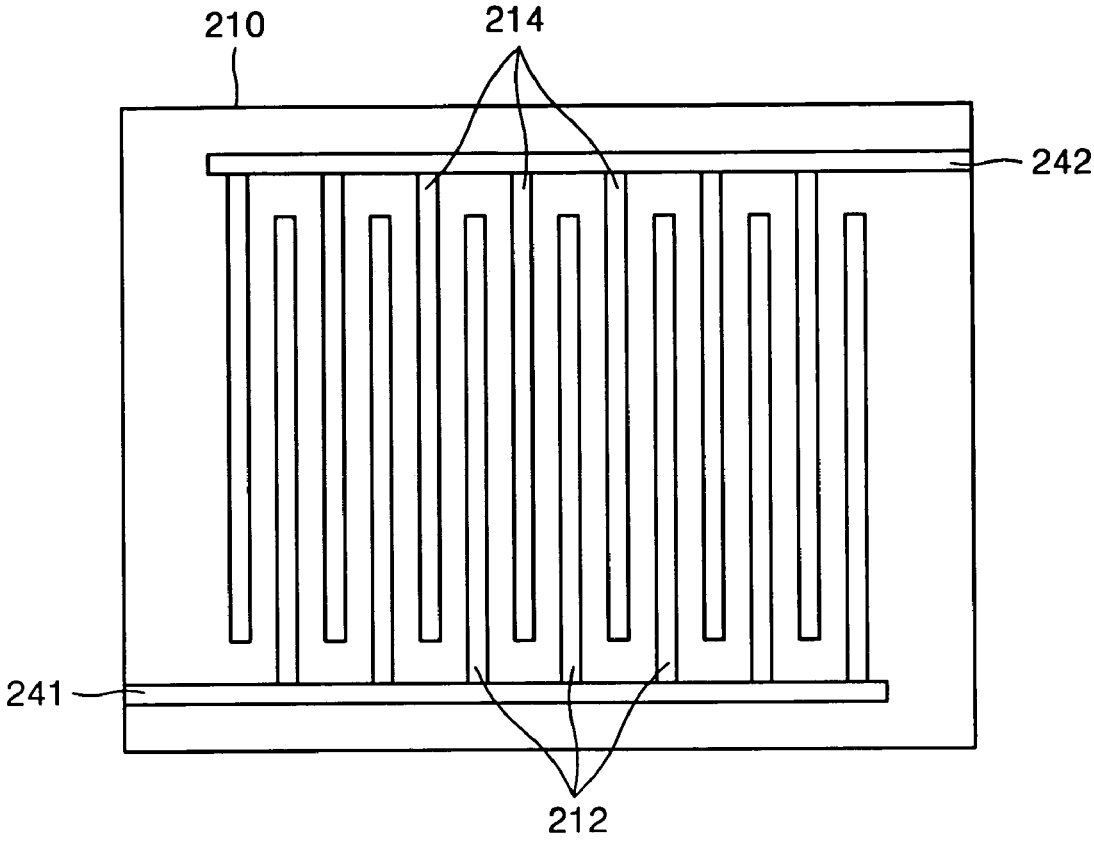
FIG. 9 is a schematic plan view of the lower panel of the backlight unit of FIG. 7 for explaining a method of driving the backlight unit.

FIG. 9 is a schematic plan view of the lower panel of the backlight unit of FIG. 7.

Referring to FIG. 9, the plurality of first electrodes 212 formed on the lower substrate 210 are connected to a first wire 241 for application of a voltage, and the plurality of second electrodes 214 alternating with the first electrodes 212 are connected to a second wire 242 for application of a voltage. The first electrodes 212 and the second electrodes 214 function as cathodes and gate electrodes alternately, as described above.

In further detail, if at the same time that an anode voltage of hundreds to thousands of volts is applied to the third electrode 222 formed on the upper substrate 221 shown in FIG. 7, a cathode voltage of zero to several tens of volts is applied to the first electrodes 212 through the first wire 241, and a gate voltage of a few to hundreds of volts is applied to the second electrodes 214 through the second wire 242, the first electrodes 212 function as cathodes such that electrons are emitted from the CNT emitters 216 formed on the first electrodes 212. Next, if a gate voltage is applied to the first electrodes 212 through the first wire 241, and a cathode voltage is applied to the second electrodes 214 through the second wire 242, the second electrodes 214 function as cathodes such that electrons are emitted from the CNT emitters 218 formed on the second electrodes 214. If the above steps are repeated, electrons are alternately emitted from the CNT emitters 216 formed on the first electrodes 212 and the CNT emitters 218 formed on the second electrodes 214. The emitted electrons are formed into a beam and radiated onto the fluorescent layer 223 formed on the upper substrate 221 shown in FIG. 7. Accordingly, fluorescent materials of the fluorescent layer 223 are excited and emit white visible light.

In the method of driving the backlight unit according to the second preferred embodiment of the present invention, alternating emission of electrons from the CNT emitters 216 formed on the first electrodes 212 and the CNT emitters 218 formed on the second electrodes 214 prolongs the life of the CNT emitters 216 and 218 more than in the first preferred embodiment. That is, if a time interval between the application of gate voltage to the first electrodes 212 and the application of gate voltage to the second electrodes 214 is made two times longer than in the first preferred embodiment, the load applied to the CNT emitters 216 and 218 is reduced, and thus the lifespan is prolonged, while the same brightness as in the first preferred embodiment can be obtained. On the other hand, if the time interval between the application of gate voltage to the first electrodes 212 and the application of gate voltage to the second electrodes 214 is maintained the same as in the first preferred embodiment, the lifespan of the CNT emitters 216 and 218 is the same as in the first preferred embodiment, but the number of electrons emitted within the same time is increased, and thus brightness is further improved.

The method of driving the backlight unit according to the second preferred embodiment has an advantage in that it can control the time interval between application of the gate voltages to the first electrodes 212 and to the second electrodes 214, thus appropriately adjusting the lifespan and brightness of the CNT emitters 216 and 218.

Steps of manufacturing the lower panel of the backlight unit according to the present invention will now be explained with reference to FIGS. 10A thru 10I.

FIGS. 10A thru 10I are schematic perspective views of the lower panel of the backlight unit according to the present invention.

As described above, the lower panels of the first and second preferred embodiments have similar structures, except that the CNT emitters of the first preferred embodiment are formed only on the first electrodes, while the CNT emitters of the second preferred embodiment are formed on both the first electrodes and the second electrodes. Accordingly, the manufacturing method will be explained based on the lower panel of the backlight unit according to the first preferred embodiment shown in FIG. 3 and, for the lower panel of the backlight unit according to the second preferred embodiment shown in FIG. 8, only the difference will be explained.

Figure 10A:
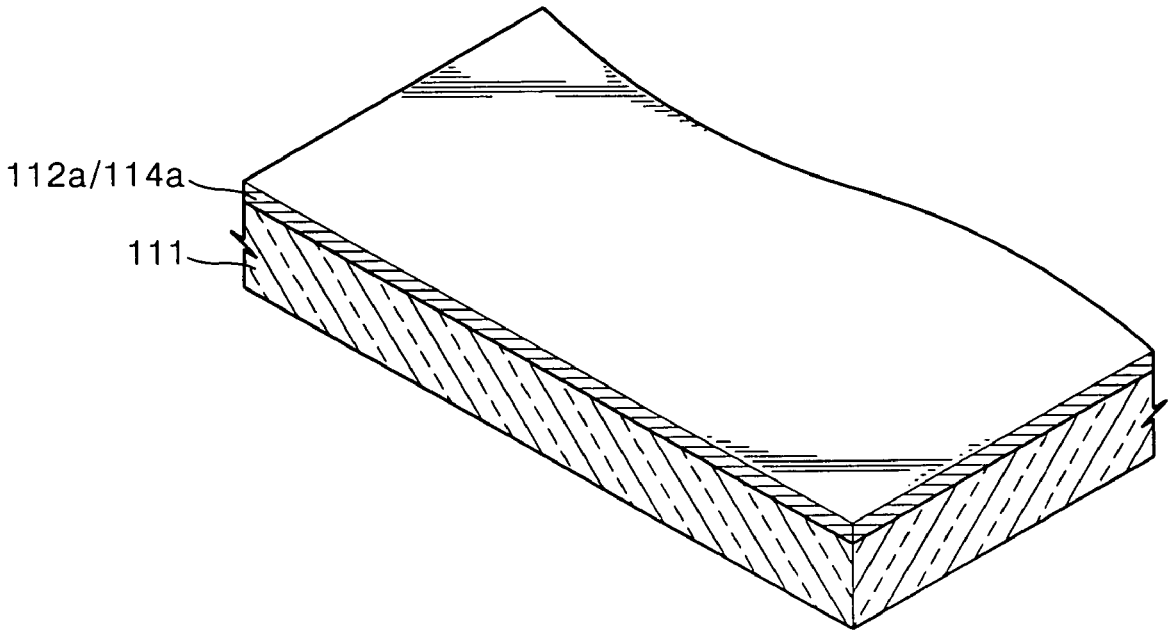
FIGS. 10A thru 10I are schematic perspective views for explaining steps of manufacturing the lower panel of the backlight unit according to the present invention.

Referring to FIG. 10A, the transparent lower substrate 111, for example, a glass substrate, having a predetermined thickness is prepared. Subsequently, the ITO electrode layers 112*a* and 114*a* are formed on the prepared lower substrate 111. The ITO electrode layers 112*a* and 114*a* may be formed by depositing transparent conductive ITO materials on the entire surface of the lower substrate 111 to a predetermined thickness, for example, hundreds to thousands of Å.

Figure 10B:
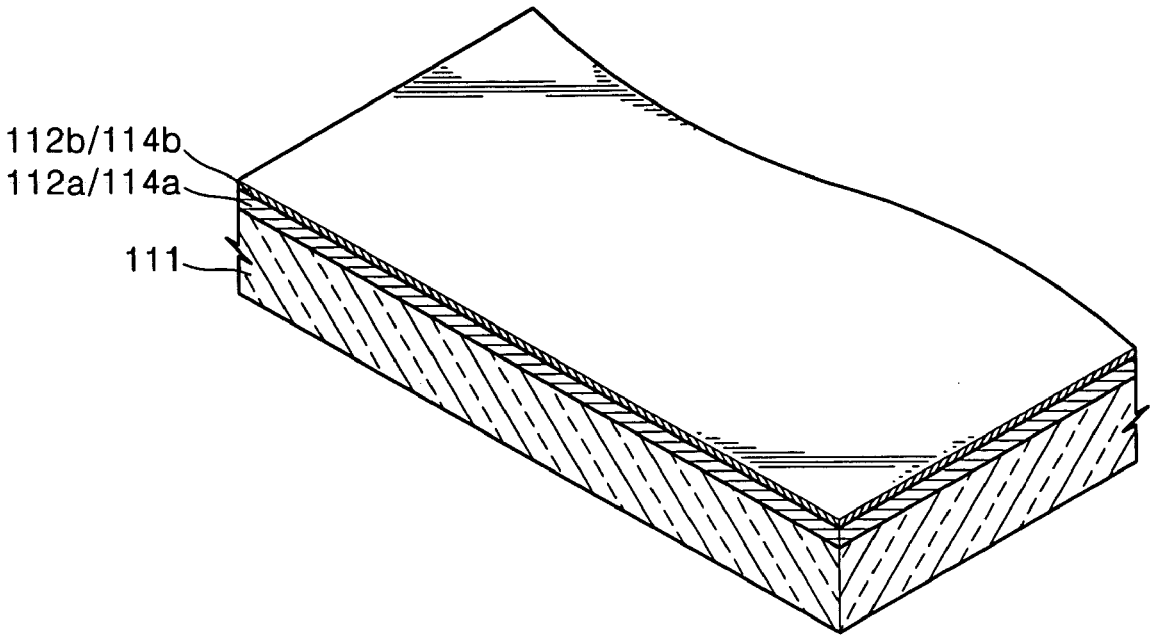

Next, as shown in FIG. 10B, the thin metal layers 112*b* and 114*b* are formed on the ITO electrode layers 1112*a* and 114*a*, respectively. The thin metal layers 1112*b* and 114*b* may be formed by sputtering conductive metal materials, e.g., chrome, on the entire surface of the ITO electrode layers 112*a* and 114*a*, respectively, to a predetermined thickness.

Figure 10C:
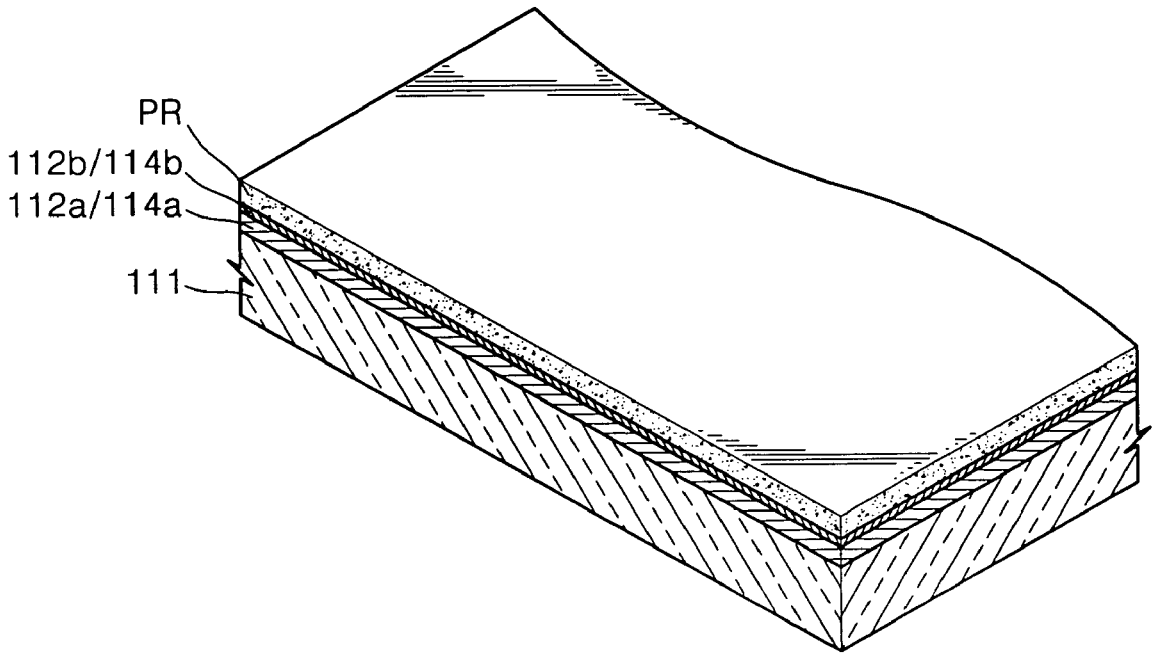

Next, as shown in FIG. 10C, a photoresist (PR) material layer is coated on the entire surface of the thin metal layers 112*b* and 114*b*.

Figure 10D:
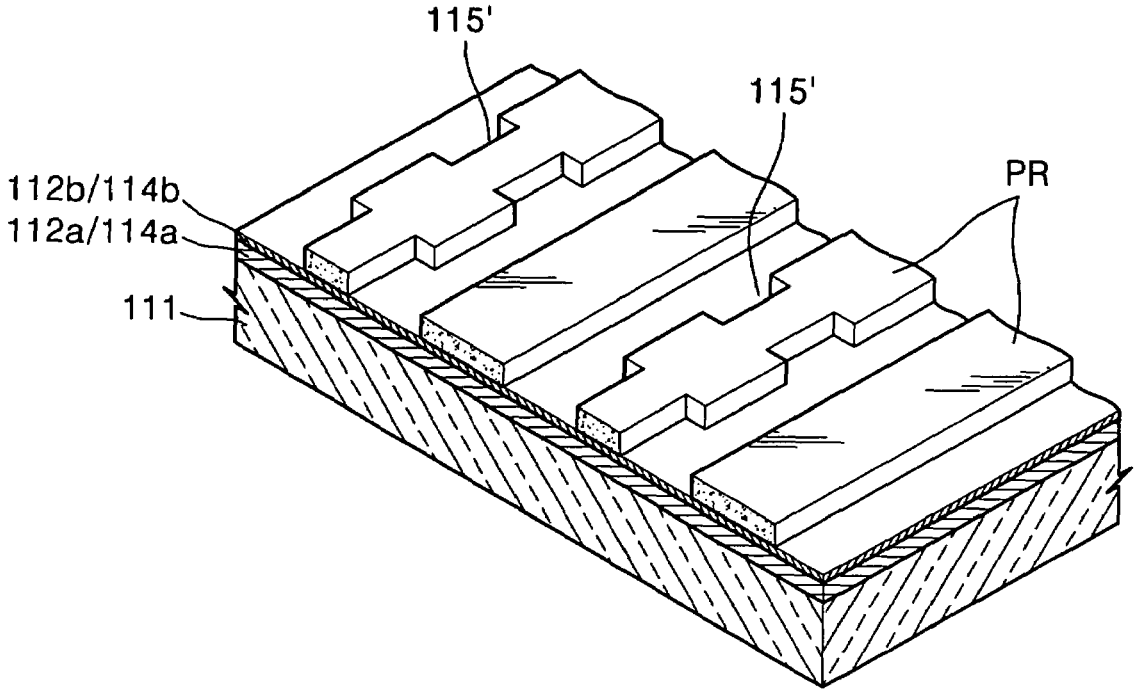

Next, as shown in FIG. 10D, the PR material layer is patterned in parallel lines by a photolithography process including exposure and development. In this case, a plurality of grooves 115' corresponding to the emitter grooves 115 shown in FIG. 3 are formed at predetermined intervals along both edges of odd or even lines of the PR material layer.

Meanwhile, when the lower panel of the backlight unit according to the second preferred embodiment of the present invention shown in FIG. 8 is manufactured, the grooves 115' are formed along both edges of all the lines of the PR material layer. Here, it is preferable that the grooves 115' formed in two adjacent lines of the PR material layer are arranged by turns.

Figure 10E:
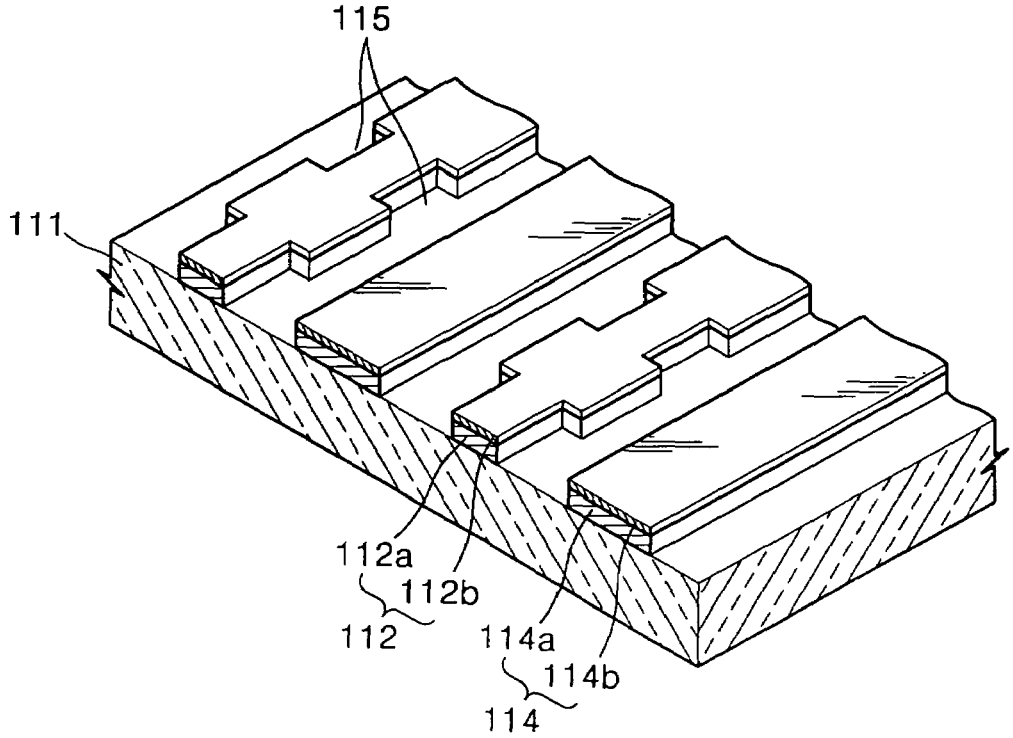

Next, the thin metal layers 112*b* and 114*b* and the ITO electrode layers 112*a* and 114*a* are etched using the patterned PR material layer as an etching mask, and then, the PR material layer is stripped off. Then, as shown in FIG. 10E, the first electrodes 112 and the second electrodes 114, including the ITO electrodes 112*a* and 114*a* and the thin metal layers 112*a* and 114*b*, are formed in parallel lines on the lower substrate 111. The plurality of emitter grooves 115 are formed along both edges of the first electrodes 112.

In the meantime, in the step described with reference to FIG. 10D, when the grooves 115' are formed along both edges of all the lines of the PR material layer to manufacture the lower panel of the backlight unit according to the second preferred embodiment of the present invention shown in FIG. 8, the emitter grooves 115 are formed along both edges of both the first electrodes 112 and the second electrodes 114.

Figure 10F:
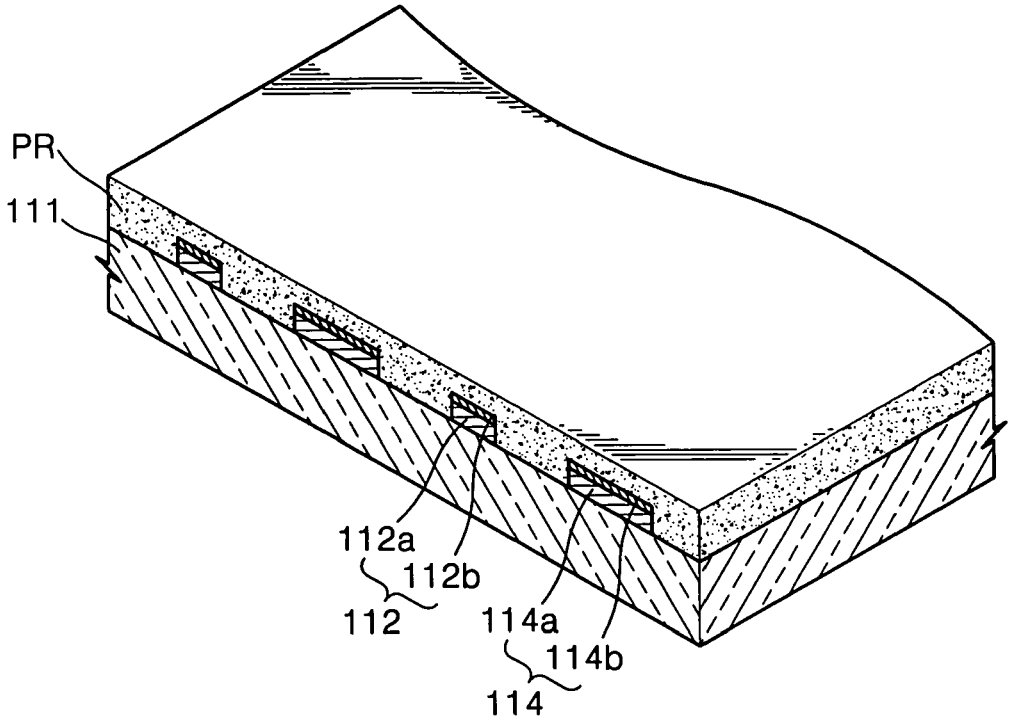

Next, as shown in FIG. 10F, a PR material layer is coated on the entire surface of the resultant structure of FIG. 10E once again.

Figure 10G:
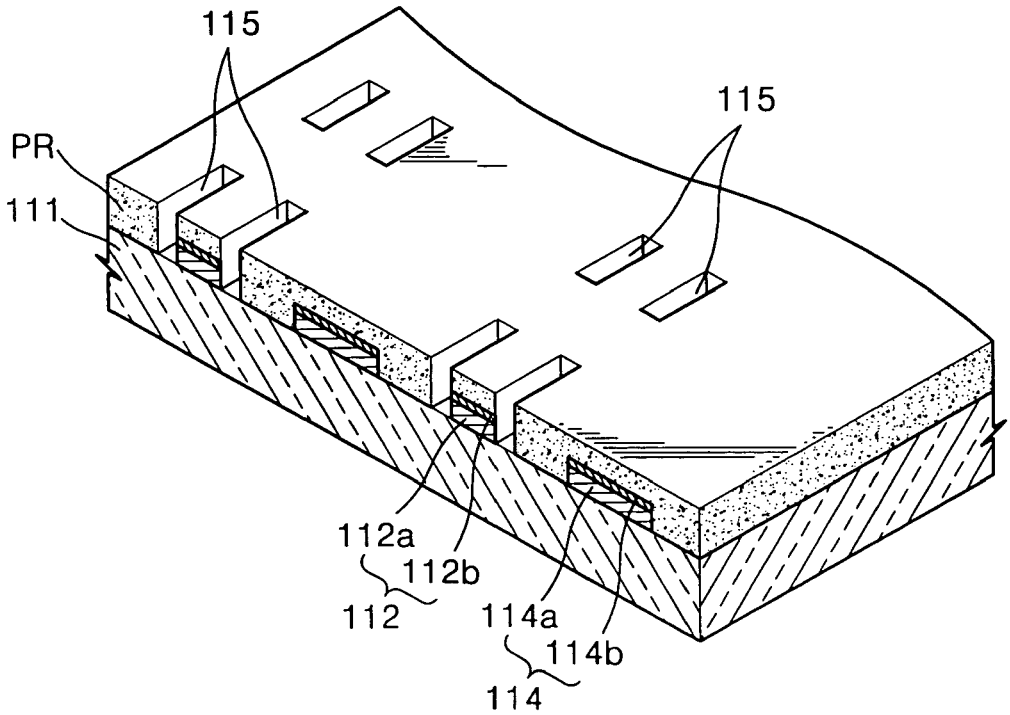

Next, as shown in FIG. 10G, the PR material layer is patterned using a photolithography process, including exposure and development, to expose the emitter grooves 115.

Figure 10H:
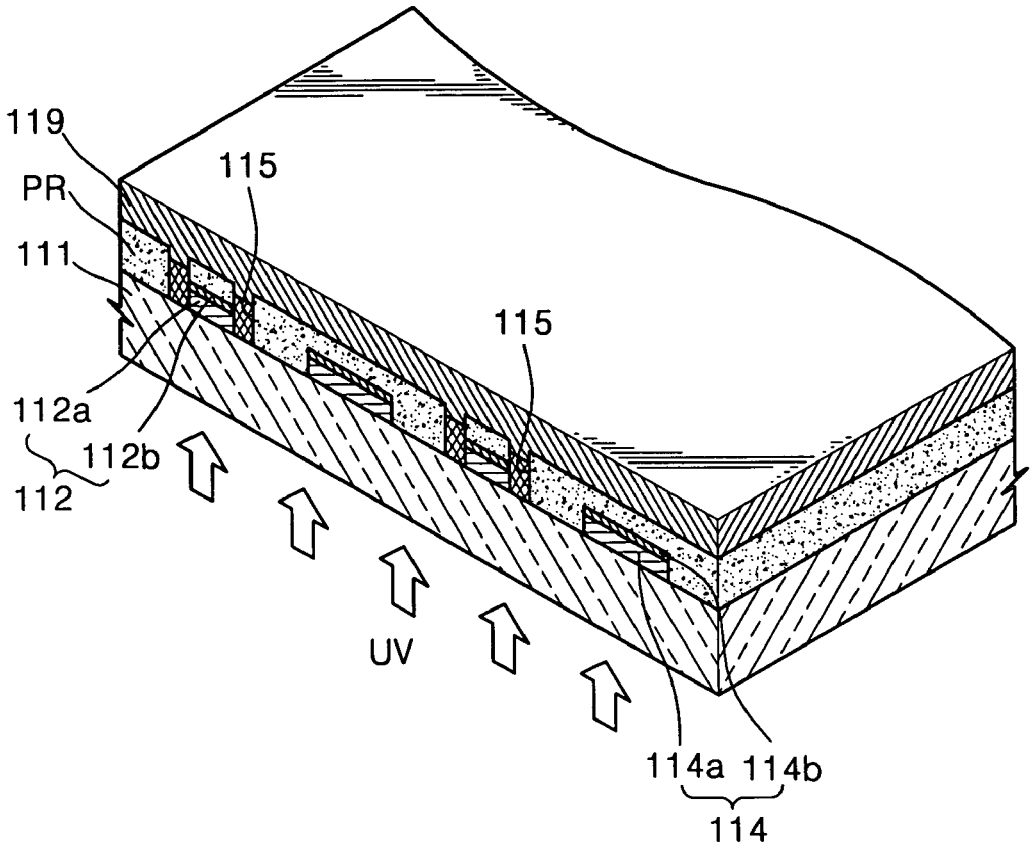

Next, as shown in FIG. 10H, a photosensitive CNT paste 119 is coated to a predetermined thickness on a surface of the resultant structure of FIG. 10G using a screen-printing method. Thereafter, light, (e.g., ultraviolet rays) is applied from a rear surface of the lower substrate 10 to selectively expose the CNT paste 119. In this case, only the CNT paste 119 within the emitter grooves 115 is exposed to the ultraviolet rays so as to be cured.

In the meantime, the CNT paste 119 can be exposed from a front surface of the lower substrate 110, but this case requires an exposure mask, which is inconvenient. If backside exposure is used, a separate exposure mask is not needed.

Figure 10I:
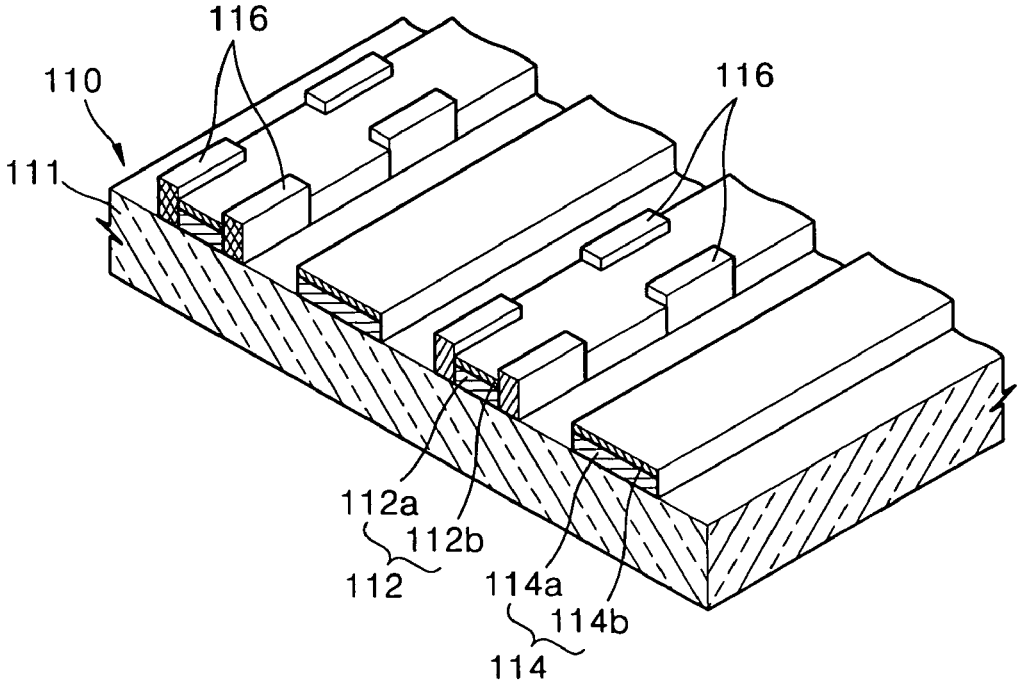

Next, if the PR material layer is removed using a developer, such as acetone, unexposed portions of the CNT paste 119 are also lifted off along with the removed PR material layer. Accordingly, as shown in FIG. 10I, only the exposed CNT paste within the emitter grooves 115 is left to form the CNT emitters 116. Through these steps, the lower panel 110 of the backlight unit according to the first preferred embodiment of the present invention is completed as shown in FIG. 10I.

As described above, since the backlight unit according to the present invention has the triode-type field emission structure, more stable field emission can be ensured.

Since the first electrodes and the second electrodes serving as the cathodes and the gate electrodes are formed in the same plane and electrons emitted from the CNT emitters are spread out while being directed toward the third electrode, uniform brightness can be obtained over the entire light emitting surface of the upper panel.

Further, since the first electrodes and the second electrodes are made of the same materials and are formed in the same plane, and thus, can be manufactured simultaneously, manufacturing processes can be simplified and manufacturing costs are reduced.

Furthermore, since CNT emitters are used, electrons can be smoothly emitted, even at a relatively low driving voltage.

Moreover, since the method of driving the backlight unit of the present invention can control the time interval between applications of the gate voltages to the first electrodes and to the second electrodes, the lifespan of the CNT emitters can be prolonged, and brightness can be improved.

In addition, since the manufacturing method of the present invention employs CNT paste, the CNT emitters can be more easily formed on a larger substrate, and since the method uses backside exposure, an additional exposure mask is not required.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A field emission backlight unit, comprising:

a lower substrate;

first electrodes and second electrodes alternately formed in parallel lines and in a same plane on the lower substrate;

emitters disposed on both the first electrodes and the second electrodes;

an upper substrate spaced apart from the lower substrate by a predetermined distance such that the upper substrate and the lower substrate face each other;

a third electrode formed on a bottom surface of the upper substrate; and a fluorescent layer formed on the third electrode;

wherein the first electrodes and the second electrodes serve as cathodes and gate electrodes alternately and the third electrode serves as an anode.

2. The backlight unit of claim 1, wherein the emitters comprise carbon nanotube emitters.

3. The backlight unit of claim 1, wherein the first electrodes and the second electrodes include indium tin oxide electrode layers formed on the lower substrate.

4. The backlight unit of claim 1, wherein the first electrodes and the second electrodes include indium tin oxide electrode layers formed on the lower substrate and thin metal layers formed on the indium tin oxide electrode layers.

5. The backlight unit of claim 4, wherein the thin metal layers are made of chrome.

6. The backlight unit of claim 1, wherein a plurality of emitter grooves are formed along both edges of both the first electrodes and the second electrodes, and the emitters are formed in the plurality of emitter grooves.

7. The backlight unit of claim 1, wherein the emitters are formed on top surfaces of both the first electrodes and the second electrodes.

8. A field emission backlight unit, comprising:

a lower substrate;

first electrodes and second electrodes alternately formed in parallel lines and in a same plane on the lower substrate;

emitters disposed on both the first electrodes and the second electrodes;

an upper substrate spaced apart from the lower substrate by a predetermined distance such that the upper substrate and the lower substrate face each other;

a third electrode formed on a bottom surface of the upper substrate; and a fluorescent layer formed on the third electrode;

wherein the first electrodes and the second electrodes serve as cathodes and gate electrodes alternately and the third electrode serves as an anode;

wherein the emitters are disposed at predetermined intervals along both edges of both the first electrodes and the second electrodes; and wherein the emitters disposed on the first electrodes and the emitters disposed on the second electrodes are arranged by turns.

9. The backlight unit of claim 8, wherein a plurality of emitter grooves are formed along both edges of both the first electrodes and the second electrodes, and the emitters are formed in the plurality of emitter grooves.

10. The backlight unit of claim 8, wherein the emitters are formed on top surfaces of both the first electrodes and the second electrodes.

11. A field emission backlight unit, comprising:

a lower substrate;

first electrodes and second electrodes alternately formed in parallel lines on the lower substrate;

emitters disposed on at least the first electrodes of the first and second electrodes;

an upper substrate spaced apart from the lower substrate by a predetermined distance such that the upper substrate and the lower substrate face each other;

a third electrode formed on a bottom surface of the upper substrate; and a fluorescent layer formed on the third electrode;

wherein the emitters disposed on at least the first electrodes of the first and second electrodes are arranged by turns.

12. A field emission backlight unit, comprising:

a lower substrate;

first electrodes and second electrodes alternately formed in parallel lines and in a same plane on the lower substrate;

emitters disposed on both the first electrodes and the second electrodes;

an upper substrate spaced apart from the lower substrate by a predetermined distance such that the upper substrate and the lower substrate face each other;

a third electrode formed on a bottom surface of the upper substrate; and a fluorescent layer formed on the third electrode;

wherein the first electrodes and the second electrodes serve as cathodes and gate electrodes alternately and the third electrode serves as an anode; and wherein the emitters disposed on the first electrodes and the emitters disposed on the second electrodes are arranged by turns.

* * * * *